US007338411B2

(12) United States Patent
Blacker

(10) Patent No.: US 7,338,411 B2
(45) Date of Patent: Mar. 4, 2008

(54) REMOVABLE EXERCISE POLE

(76) Inventor: Randy Eugene Blacker, 3755 Prescott Ave., San Jose, CA (US) 95124

( * ) Notice: Subject to any disclaimer, the term of this patent is extended or adjusted under 35 U.S.C. 154(b) by 495 days.

(21) Appl. No.: 10/794,484

(22) Filed: Mar. 4, 2004

(65) Prior Publication Data

US 2004/0220031 A1 Nov. 4, 2004

Related U.S. Application Data

(60) Provisional application No. 60/466,019, filed on Apr. 28, 2003.

(51) Int. Cl.
*A63B 69/00* (2006.01)
*A63B 26/00* (2006.01)
*A63B 9/00* (2006.01)

(52) U.S. Cl. ..... 482/33; 482/148; 482/904; 482/907

(58) Field of Classification Search ..... 482/23, 482/33, 34, 37, 39, 40, 89, 91, 907, 94–96, 482/148, 908; 248/354.1, 200.1; 473/136; 182/189

See application file for complete search history.

(56) References Cited

U.S. PATENT DOCUMENTS 3,333,808 A * 8/1967 Du Boff ..... 248/200.1
3,572,511 A * 3/1971 Triplett ..... 211/105.6
3,595,209 A * 7/1971 Parker ..... 119/706
3,604,397 A * 9/1971 Salerno ..... 119/706
3,642,278 A * 2/1972 Hinckley ..... 482/38
3,645,487 A * 2/1972 Gilchrist ..... 248/200.1
3,707,285 A * 12/1972 Martin ..... 482/38
4,498,204 A * 2/1985 Warner ..... 4/559
4,839,987 A 6/1989 Cosandier
5,423,730 A * 6/1995 Hirsch ..... 482/92
5,536,229 A * 7/1996 Albergo ..... 482/148
5,653,415 A * 8/1997 Schworer ..... 248/354.1
5,826,847 A * 10/1998 Warner et al. ..... 248/354.1
5,833,081 A * 11/1998 Smith ..... 211/86.01
5,989,158 A * 11/1999 Fredette ..... 482/38
6,042,066 A 3/2000 Maharg et al.
6,120,415 A * 9/2000 Paull et al. ..... 482/38
6,554,235 B1 * 4/2003 Fortier ..... 248/122.1

* cited by examiner

*Primary Examiner*—Kevin C. Sirmons
*Assistant Examiner*—Victor K. Hwang

(57) ABSTRACT

It is the object of the current invention to provide a removable exercise pole with a base connected with a housing pole that is extended by means of a telescoping upper extension pole. The pole is held in place by a compressive tensioning mechanism that also allows for manual adjustment. The pole is held in constant tension so that horizontal forces may be resisted. A capture plug that may be selectively mounted on an overhead horizontal surface serves to locate the pole on the overhead surface.

10 Claims, 2 Drawing Sheets

REMOVABLE EXERCISE POLE

CROSS-REFERENCE TO RELATED APPLICATIONS

This Application claims priority to provisional patent Ser. No. 60/466,019 filed on Apr. 28, 2003.

BACKGROUND

The present invention related generally to support poles mounted floor to ceiling. In particular, the present invention relates to an exercise pole that may be temporarily mounted floor to ceiling.

There exist a variety of poles that may be mounted floor to ceiling as well as poles that may be mounted between parallel vertical surfaces (e.g., a shower rod). In most cases, the floor to ceiling poles are arranged either to serve as support structures as, for example, in modern cubical spaces, or to hold objects in static position as, for example, a bicycle holder. These poles are particularly well-adapted to temporary and rapid placement throughout an interior building space. In many applications, poles are erected and then subject to static loads—holding objects or holding a position of an object. Static loads may be accounted for in design and require much less structural strength that a similar load applied dynamically. Thus, for example, a bicycle pole designed to hold 3 or fewer bicycles may be capable of withstanding the combined static weight of more than 3 bicycles in the vertical axis, but may not withstand a similar weight applied dynamically in the horizontal axis. In this example, the ability to withstand horizontal forces is not required. However, in an application where dynamic loads in the horizontal direction are needed as, for example, in an exercise environment where the pole is used not only for balance, but for strength training, it would beneficial to have a floor to ceiling pole that can withstand horizontal dynamic forces.

There exists, in today's fitness market, a surge in exercise equipment that is rapidly evolving to meet society's changing lifestyle. Exercise equipment ranges from expensive single purpose machines to inexpensive isometric devices like bungee cord pulls. An example of an inexpensive, yet extremely useful device is the dance barre employed by ballet dances for many years. A typical dance barre comprises a horizontal barre that is either a permanently installed or freely standing device. A barre is useful to assist a dancer to hold her balance while practicing and stretching in ways that would not be possible unassisted. While a dance barre can typically withstand dynamic loading, its configuration (e.g., horizontal installation) limits the use to more traditional dance exercise.

SUMMARY

It is the object of the current invention to provide a removable exercise pole with a base connected with a housing pole that is extended by means of a telescoping upper extension pole. The pole is held in place by a compressive tensioning mechanism that also allows for manual adjustment. The pole is held in constant tension so that horizontal forces may be resisted. A capture plug that may be selectively mounted on an overhead horizontal surface serves to locate the pole on the overhead surface.

It is a further object of the present invention to provide rubberized feet on the base to provide friction on smooth surfaces. The feet may also be made of spiked metal or hard plastic to provide traction on non-smooth surfaces like carpet, rubberized material, or other non-smooth surfaces.

The manual adjustment mechanism of the present invention may be accomplished through the use of a threaded rod that extends the pole so that the tensioning mechanism may engage an overhead horizontal surface. Further, the present invention may be circular in cross-section and may be assembled in a variety of different manners.

It is still a further object of the present invention to provide a method of installing a removable exercise pole by: providing a removable exercise pole; locating a capture plug on an upper planar surface that is generally parallel to a lower planar surface; locating the removable exercise pole so that the upper end of the pole is captured by the capture plug; adjusting the manual adjustment mechanism so that the tensioning mechanism may fully engage; and positioning the pole in a position substantially perpendicular to the lower planar surface.

Notably, the pole may be configured as to be partially disassembled into 2 or more sections for easier transport and storage.

DETAILED DESCRIPTION OF THE DRAWINGS

Figure 1:
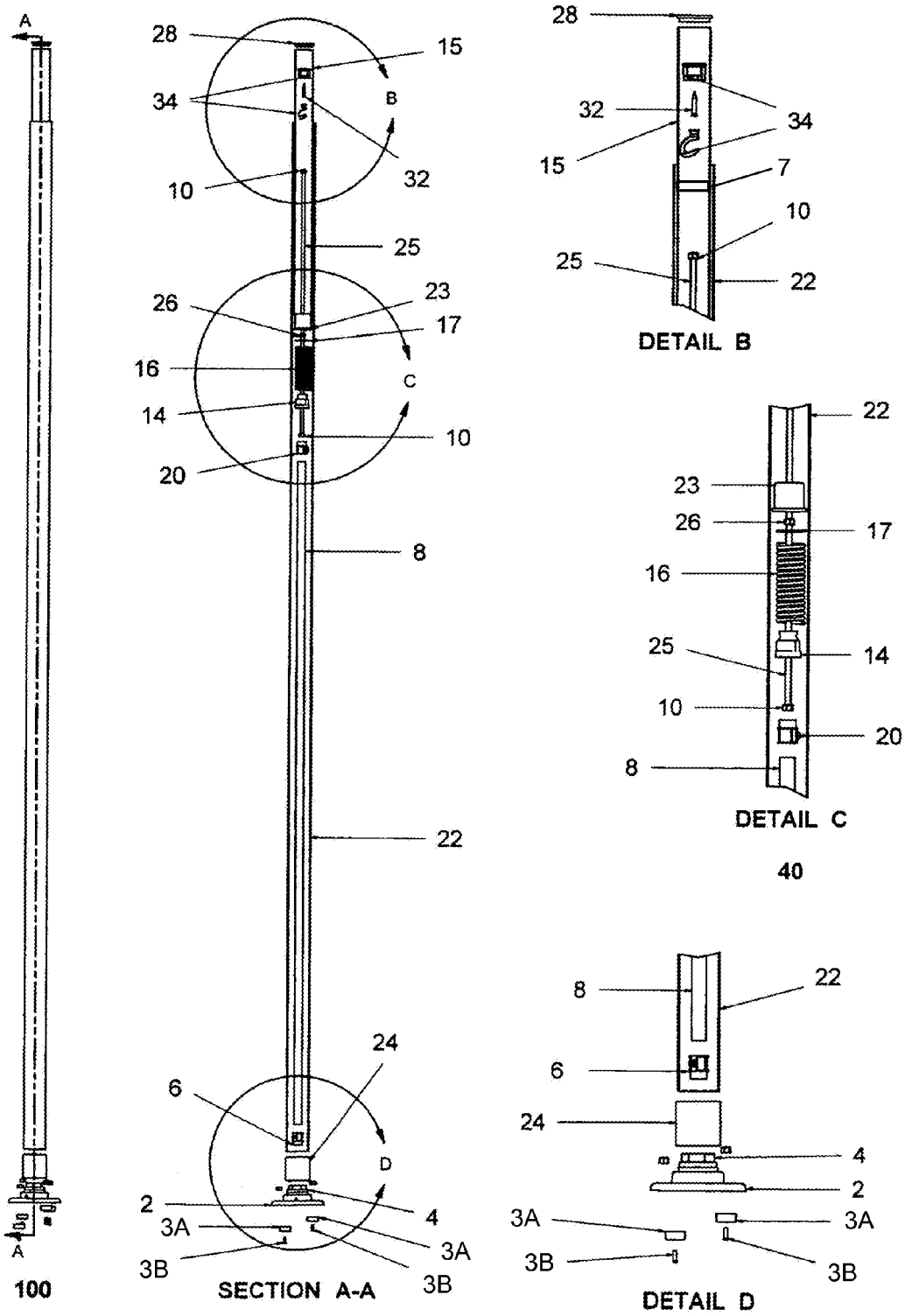
FIG. 1 is an exploded diagrammatic view of the present invention.

FIG. 1 illustrates an exploded diagrammatic view of the present invention. A base (2) is utilized to widen the gripping surface of the exercise pole (100). In one embodiment, rubberized feet (3A) are attached to the bottom surface of the base (2). As can be appreciated by one skilled in the art, the rubberized feet (3A) allow the base (2) to more firmly grip a flooring surface as to allow the exercise pole (100) to withstand lateral forces (301-309 (FIGS. 3A-3B)). In other embodiments, the rubberized feet (3A) may be replaced with metal spikes (3B) to allow the exercise pole sufficient gripping power in soft surfaces like carpet, artificial turf, composite surfaces and the like.

A reducing bushing (4) is threaded into the base that serves to accommodate an adapter (6) and a coupler (24). The coupler (24) will be discussed below. The adapter (6) permits a spacer tube (8) to be attached with the base. The spacer tube (8) is part of the tensioning mechanism that allows the exercise pole (100) to be easily placed and removed. The spacer tube (8) is disposed within the lower outer housing pole (22). At the distal end of the spacer tube (8) is capped with an additional adapter (20). The spacer tube (8) is generally made with a lightweight rigid material like conduit. However, as can be appreciated by one skilled in the art, where weight is not a concern, threaded pipe will work equally well. Additionally, composite materials like PVC, iron pipe, steel tubing, or aluminum tubing, which is well known in the art, may be used, but must be sufficiently rigid as to not flex under the compressive force generated by a spring (16).

The adapter (20) is attached with the end of the spacer (8). A bell housing reducer (14) is attached with the adapter (20). The bell housing reducer (14) functions to serve as a spring stop and as a stop nut-capturing device. Thus the bell housing reducer's (14) outer diameter is sufficiently large so that the spring (16) will not extend past the reducer (14) and sufficiently small as to be completely disposed within the lower outer housing (22). The spring (16) serves to provide compressive force for the upper extension pole (15) when the exercise pole (100) is installed. Because of the high degree of lateral forces exerted on the pole when in use, a simple locking threading adjustment might be dislodged from the capture plug (28) as the pole flexes and bends. The spring (16) automatically extends the upper extension pole (15) under such conditions. The spring (16) is sized to allow approximately one inch of compression when the upper extension pole (15) is installed. The spring (16) is further sized to exert approximately 60 p.s.i. of compressive force under at least one inch of compression.

A threaded rod (25) serves as an adjustment for the upper extension pole (15) to accommodate differing installation depths. An indicator (7) may be attached with the upper extension pole (15) to mark the maximum extension of the upper extension pole (15). In one embodiment the indicator includes a stripe. In one embodiment, both ends of the threaded rod (25) are capped with stop nuts (10). As may be appreciated by one skilled in the art, any suitable stopper may be used such that the bell housing reducer (14) cannot escape the threaded rod (25) on one end and such that the adjustment cup (23) cannot escape the threaded rod on the other end. In another embodiment, the ends of the threaded rod are bent in such a manner as to serve the same function as a stop nut. The tension mechanism (40) further comprises a spring stop (17) and a spring stop nut (26). The spring stop (17) is sized to a width that exceeds the spring (16) such that the spring (16) is retained by the spring stop (17). The spring stop nut (26) is threaded onto the threaded rod (25) and allows the manufacturer to impart approximately 1/16 inch compression on the spring (16) prior to complete assembly by rotating the stop nut (26) about the longitudinal axis of the threaded rod (25) until the proper compression of the spring (16) is obtained. Imparting a minimum compression on the spring allows the assembly to function without undue rattling of parts.

The tension mechanism (40) further comprises an adjustment cup (23). The adjustment cup (23) captures the lower portion of the upper extension pole (15) and is threaded onto the threaded rod (25). To accommodate for differing installation height, upper extension pole (15) is captured at one end by capture plug (28) and may be mechanically and continuously adjusted. In some embodiments, adjustments may be made such that the spring may be compressed at a minimum range of approximately 0.75-2.00 inches when exercise pole (100) is fully installed. The adjustment cup (23) is sized such that it may move freely within the lower outer housing (22).

Turning now to the lower outer housing (22). The lower outer housing (22) is fixedly connected with the base (2). A coupler (24) is threaded onto the lower portion of the lower outer housing (22) as well as to the reducing bushing (4) that is, in turn, connected with the base (2). It may be appreciated by one skilled in the art that this invention contemplates alternative methods of attachment of the lower outer housing (22) with the base (2) including, but not limited to, welding, brazing, gluing, or any other method of attachment well-known in the art. The lower outer housing (22) is manufactured from a rigid material such as pipe or steel tubing. The lower outer housing (22) must be sufficiently rigid to withstand the lateral forces exerted upon the assembly during use. The lower outer housing (22) must also be sufficiently large in diameter to accommodate the internal components discussed above. Further, the lower outer housing (22) must be sufficiently large in diameter to be easily gripped and held. Thus, in an embodiment of the present invention, the outside diameter of the lower outer housing (22) is at least one inch and not greater than three inches. The length of the lower outer housing (22) along with the upper extension pole (15) may be variable within prescribed limits. In an embodiment of the present invention, the upper extension pole (15) is preferably no longer than one-fourth the length of the lower outer housing (22). Further, the length of the lower outer housing (22) may be sized to accommodate any height of ceiling. Notably, this disclosure is not intended to be limiting with respect to the height of the respective poles, as one skilled in the art will recognize, both shorter and longer lengths are contemplated without departing from this invention.

Finally, a suitably located capture plug (28) is mounted on a surface. The capture plug (28) retains the upper end of the upper extension pole (15). The capture plug (28) must be mounted on a surface such that it will withstand the lateral forces exerted upon the assembly. There exist many methods well known in the art for suitably locating and securing the capture plug (28). In one embodiment, the capture plug (28) is a washer that is connected by a screw (32) to a stud in a ceiling. In another embodiment, the capture plug (28) is glued to a surface. In yet another embodiment, the capture plug (28) is further comprised of a decorative hook (34), which may be used to hang plants or decorations. In some embodiments, capture plug (28) is a synthetic washer. One reason why a user would utilize a decorative hook (34) in conjunction with the present invention, is that should the user finds the capture plug (28) unsightly, the decorative hook (34) may mask the appearance of the capture plug (28). Other methods of disguise may be utilized without departing from the present invention.

Figure 2:
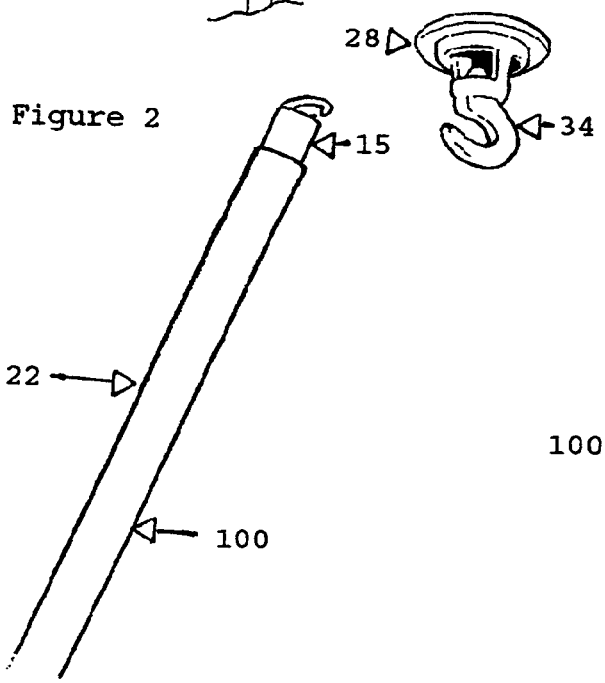
FIG. 2 is an illustration of the present invention during installation.

FIG. 2 is an illustration of the present invention during installation. As illustrated, a decorative hook (34) and a capture plug (28) are securely fastened to a ceiling or other appropriate overhead horizontal surface. The exercise pole (100) is firmly grasped by the lower outer housing pole (22) and held at an oblique angle with respect to the overhead horizontal surface. The upper extension pole (15) is located over the decorative hook (34) and aligned with the capture plug (28). Upward force is then exerted upon the exercise pole (100) to compress the upper extension pole (15) within the lower outer housing pole (22). The base (2) of the exercise pole (100) is then located directly beneath the capture plug (28) to provide maximum compression of the tension mechanism (40). Any number of methods to assure correct alignment well-known in the art may be utilized such as the use of a level, use of a plumb bob, or direct measurement from adjacent perpendicular walls. Once proper placement has been achieved, a locating mark may be utilized to ease future installation. Removal of the exercise pole (100) is easily accomplished by exerting an upward force on the lower outer housing pole (22) and sliding the base (2) in any direction free of obstacles. Once the decorative hook (34) has been cleared, the exercise pole (100) may be freely removed from its installed location.

Figure 3A:
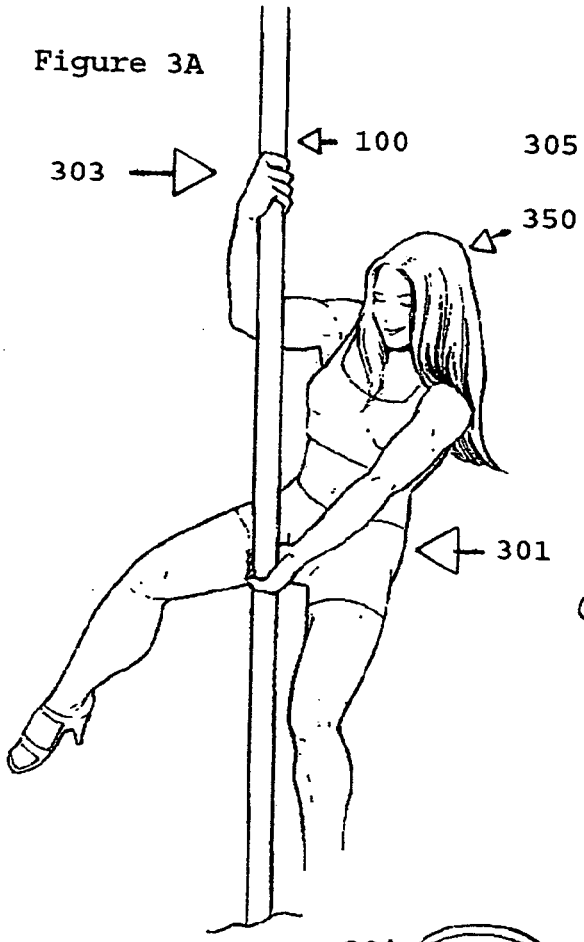
FIGS. 3A-3C are illustrations of the present invention during use.
Figure 3B:
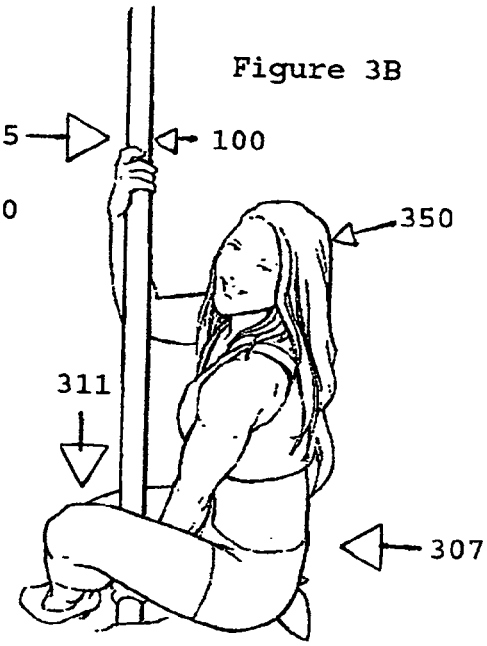
Figure 3C:
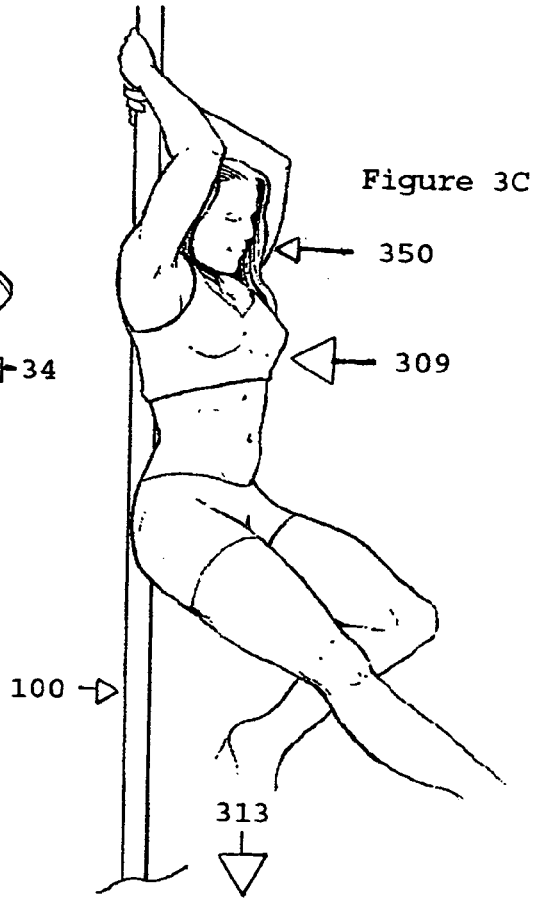

FIGS. 3A-3C are illustrations of the present invention during use. FIG. 3A illustrates a person (350) exerting opposing lateral forces (301, 303) on the exercise pole 100. Because the exercise pole (100) is captured in spring tension with two horizontal surfaces, the person (350) may safely exert opposing lateral forces (301, 303) on the pole without fear of the pole failing. Thus, when the person (350) wished to simultaneously push and pull in, for example, an isometric toning exercise, the exercise pole (100) will safely accommodate that action.

FIG. 3B illustrates a person (350) exerting opposing lateral forces (305, 307) as well as a vertical downward force (311) on the exercise pole (100). As is often encountered in pole exercise, the person utilizing the pole may wish to climb up the pole by shimmying up. The action of both shimmying up the pole and sliding down the pole is likely to exert both lateral and vertical downward forces on the pole. Again, because the exercise pole (100) is captured in spring tension with two horizontal surfaces, the person (350) may safely exert opposing lateral forces (301, 303) as well as vertical downward force (311) on the pole without fear of the pole failing. Furthermore, the vertical downward force (311) enhances the stability of the pole by imparting more tension on the base (2) of the exercise pole (100). Thus, it may be expected that a heavier person exerting similar forces on the pole will suffer no loss in stability and may, in fact, benefit from greater stability. Because the upper extension pole (15) is held in spring tension rather than from, for example, tension exerted by a clamping, locking, or screw action, the exercise pole (100) may flex in response to lateral and vertical downward forces without fear of release from the capture plug (28) that would result in pole failure.

FIG. 3C illustrates a person (350) exerting a lateral force (309) and a vertical downward force (313) on the exercise pole (100). In this illustration, the person (350) is maintaining a stretching position while controlling the amount of weight on her flexed knee by firmly grasping and leaning onto the exercise pole (100). This typical example demonstrates that a single lateral force (309) may be exerted on the pole without fear of pole failure. In addition, the vertical downward force (313) provided by the person further stabilizes the pole as explained above. In the instance where only a lateral force is exerted on the pole, the pole remains effectively stable where the force is exerted above approximately the bottom 50% of the length of the entire pole.

As may be understood by one skilled in the art, the described embodiments are for illustrative purposes. Other embodiments and uses may be contemplated without departing from the breadth and scope of the present invention as described herein. As such, no language used to describe the present invention is intended to be self-limiting, rather a reasonable interpretation and construction of the language used herein is contemplated.

What is claimed is:

1. A removable exercise pole comprising:

(a) a base;

(b) a lower outer housing pole fixedly connected with the base;

(c) an upper extension pole being manually and mechanically telescopable with respect to said lower outer housing pole;

(d) a tensioning mechanism comprising a compression mechanism and an adjustment mechanism, the compression mechanism and the adjustment mechanism housed within the lower outer housing pole, wherein the compression mechanism comprises a spacer disposed within the lower outer housing pole secured with the base or the lower outer housing at an end and with a compressible spring at an opposite end, and wherein the adjustment mechanism provides telescopic movement for the upper extension pole such that the upper extension pole may be held in constant tension by the compression mechanism, wherein the adjustment mechanism comprises an adjustment cup removably secured with the upper extension pole and rotatably connected with a threaded rod, the threaded rod captured by the spacer and held in tension by the spring, and wherein the threaded rod further comprises a stop nut at a lower end such that the threaded rod cannot escape the spacer at the lower end; and (e) a capture plug such that the upper extension pole is held in position when engaged in tension with an upper planar surface.

2. A removable exercise pole as in claim 1 wherein the base further comprises rubberized feet capable of absorbing downward mechanical force and providing friction on a lower planar surface against horizontal forces.

3. A removable exercise pole as in claim 1 wherein the base further comprises spiked feet capable of providing friction on a soft lower planar surface.

4. A removable exercise pole as in claim 1 wherein the threaded rod further comprises another stop nut at an upper end such that the adjustment cup cannot escape the threaded rod at the upper end.

5. A removable exercise pole as in claim 1 wherein the capture plug is a synthetic washer.

6. A removable exercise pole as in claim 1 wherein the upper extension pole and the lower outer housing pole are circular in cross-section.

7. A removable exercise pole as in claim 1 wherein the lower outer housing pole is slidable over the upper extension pole.

8. A removable exercise pole as in claim 1 wherein the upper extension pole is clearly marked with an indicator so that a user will not extend the pole beyond the indicator.

9. A removable exercise pole as in claim 8 wherein the indicator is a stripe.

10. A removable exercise pole as in claim 1 wherein the capture plug further comprises a decorative hook whereby the hook may effectively disguise the capture plug.

* * * * *